US006081068A

United States Patent [19]

Sudo et al.

[11] Patent Number: 6,081,068

[45] **Date of Patent: *Jun. 27, 2000**

[54] COLOR CATHODE RAY TUBE HAVING IMPROVED MAIN LENS ELECTRODES

[75] Inventors: Akihito Sudo, Mobara; Satoshi Moriwaki, Ichihara; Mitsuhiro Sugiyama, Chousei-gun, all of Japan

[73] Assignees: Hitachi, Ltd., Tokyo; Hitachi Devices Co., Ltd., Mobara, both of Japan

[ * ] Notice: This patent is subject to a terminal disclaimer.

[21] Appl. No.: 09/247,088

[22] Filed: Feb. 9, 1999

Related U.S. Application Data

[63] Continuation of application No. 08/916,710, Aug. 25, 1997, Pat. No. 5,886,462.

[30] Foreign Application Priority Data

| | | | |
|---|---|---|---|
| Sep. 10, 1996 | [JP] | Japan | 8-239498 |
| Nov. 6, 1996 | [JP] | Japan | 8-293946 |
| Jun. 17, 1997 | [JP] | Japan | 9-159497 |

[51] Int. Cl.[7] ..... H01J 29/50

[52] U.S. Cl. ..... 313/412; 313/414; 313/448; 313/449

[58] Field of Search ..... 313/412, 414, 313/446, 449, 448, 413

[56] References Cited

U.S. PATENT DOCUMENTS

| | | | |
|---|---|---|---|
| 4,668,892 | 5/1987 | Peels | 313/414 |
| 5,886,462 | 3/1999 | Sudo et al. | 313/412 |

*Primary Examiner*—Vip Patel
*Assistant Examiner*—Michael J. Smith
*Attorney, Agent, or Firm*—Antonelli, Terry, Stout & Kraus, LLP

[57] ABSTRACT

A color cathode ray tube includes a phosphor screen, a shadow mask closely spaced from the phosphor screen and an electron gun. The electron gun includes three cathodes for emitting three in-line electron beams and a plurality of electrodes each having electron beam apertures for passing the electron beams, the electrodes are fixed in a predetermined axially spaced relationship on insulating supports, at least one of the electrodes is cup-shaped and has a correction plate electrode therein welded thereto, and edges of the correction plate electrode are formed with recesses and have sloped portions extending in a direction away from the recesses toward an inner wall of the electrode containing the correction plate electrode.

14 Claims, 15 Drawing Sheets

COLOR CATHODE RAY TUBE HAVING IMPROVED MAIN LENS ELECTRODES

CROSS REFERENCE TO RELATED APPLICATION

This is a continuation of U.S. application Serial No. 08/916,710, filed Aug. 25, 1997, now U.S. Pat. No. 5,886, 462, the subject matter of which is incorporated by reference herein.

BACKGROUND OF THE INVENTION

The present invention relates to a color cathode ray tube, and particularly to a color cathode ray tube having precision main lens electrodes for an in-line type electron gun.

Color cathode ray tubes such as a color picture tube, a display tube, and the like are widely used as a receiver of TV broadcasting or as a monitor in an information processing apparatus for their high-definition image reproduction capability.

The color cathode ray tube of this kind includes a vacuum envelope comprised of at least a funnel having a faceplate carrying a phosphor screen on its inner surface at one end thereof, and a neck connected to the end of the funnel housing therein an electron gun structure for emitting electron beams toward the phosphor screen.

FIG. 15 is a schematic sectional view for explaining the configuration of a shadow mask type color cathode ray tube as one example of a color cathode ray tube to which the present invention is applied. Reference numeral 20 designates a faceplate, 21 a neck, 22 a funnel for connecting the faceplate to the neck, 23 a phosphor screen formed on the inner surface of the face plate to constitute an imaging screen, 24 a shadow mask which is a color selection electrode, 25 a mask frame for supporting the shadow mask to constitute a shadow mask structure, 26 an inner shield for shielding external magnetic fields, 27 a suspension spring mechanism for suspending the shadow mask structure on studs heat-sealed to the inner side wall, 28 an electron gun housed in the neck for emitting three electron beams Bs (×2) and Bc, 29 a deflection device for horizontally and vertically deflecting the electron beams, 30*a* magnetic device for carrying out a color purity adjustment and a centering adjustment, 31 a getter, 32 an internal conductive coating, and 33 an implosion protection band.

In the configuration shown in FIG. 15, the faceplate 20, the neck 21 and the funnel 22 constitute a vacuum envelope. Three electron beams Bc, and Bs×2 emitted in a line from the electron gun are horizontally and vertically deflected by magnetic fields formed by the deflection device 29 to scan the phosphor screen 23 two-dimensionally.

The three electron beams Bs, Bc×2 are respectively modulated by color signals of red (side beam Bs), green (center beam Bc) and blue (side beam Bs) and subjected to color selection in beam apertures in the shadow mask 24 disposed immediately in front of the phosphor screen 23 to impinge upon a red phosphor, a green phosphor and a blue phosphor of the mosaic three color phosphors of the phosphor screen 23, thereby reproducing a desired color image.

FIG. 16 is a top view of main parts for explaining a structural example of an in-line type electron gun structure used for the color cathode ray tube shown in FIG. 15. Reference numeral 10 designates a cathode, 11 a first grid electrode serving as a control electrode, 12 a second grid electrode, 13 a third grid electrode, 14 a fourth grid electrode, 15 a fifth grid electrode, 16 a sixth grid electrode, 16*a* a correction plate electrode in the sixth grid electrode 16, 17 an anode, 17*a* a correction plate electrode in the anode, 18 a shield cup, and 19 insulating supports (only one of two is shown).

In the electron gun, three electron beams generated in a triode constituted by the cathode 10, the first grid electrode 11 and the second grid electrode 12 are accelerated and preliminarily focused by the third grid electrode 13, the fourth grid electrode 14 and the fifth grid electrode 15, focused as desired by a main lens formed between the opposing surfaces of the sixth grid electrode and the anode 17, and they are directed toward the phosphor screen as shown in FIG. 15.

In the electron gun of this type, the fifth electrode 15, the sixth electrode 16 and the anode 17 constituting the focus lens are cup-shaped. Particularly, each of the grid electrode 16 and the anode 17 constituting the final lens has a single opening surrounded by an in-turned rim on mutually facing ends thereof and has a correction plate electrode 16*a*, 17*a* therein set back from the mutually facing ends thereof which has an individual aperture therein for each of the electron beams, respectively.

FIGS. 17A and 17B are schematic sectional views for explaining a main lens forming electrode of the aforementioned type electrode gun. FIG. 17A is a sectional view in parallel with the in-line direction of the three beams, and FIG. 17B is a sectional view perpendicular to the in-line direction.

In FIGS. 17A and 17B, the sixth grid electrode 16 has a single opening 16-1 in the end face of the sixth grid electrode 16 opposing the anode 17, surrounded by a rim turned in an axial distance H toward the interior of the sixth grid electrode 16, and has a correction plate electrode 16*a* having three beam apertures therein corresponding to the number of the electron beams and disposed at a position therein set back a distance d1 from the single opening toward the interior of the sixth grid electrode, and similarly the anode 17 has a single opening 17-1 in the end face of the anode opposing the sixth grid electrode 16 across a spacing g, surrounded by a rim turned in an axial distance H toward the interior of the sixth electrode 16, and has a correction plate electrode 17*a* having three beam apertures therein corresponding to the number of the electron beams end disposed at a position therein set back a distance d2 from the single opening toward the interior of the anode. The correction plate electrode 17*a* has an opening for passing a center electron beam and forms passageways for side electron beams in cooperation with the inner wall of the cup-shaped anode 17. A combination of the single openings 16-1, 17-1 and the correction plate electrodes 16*a*, 17*a* produces an effectively large diameter electron lens. Japanese Patent Application Laid-Open No. 4-43532 Publication discloses an above-described effectively large diameter main lens formed by provision of oval rims in opposing end faces of a pair of electrodes in the main lens and correction plate electrodes set back from the respective opposing end faces toward the interiors of the respective electrodes.

FIGS. 18A to 18C are schematic sectional views for explaining the shapes of the electrodes for a main lens of the conventional electron gun. Generally, the inner wall of the cup-shaped electrode 16 (17) is formed to have an axially uniform inside diameter (in major and minor axis directions) from the open end A to the opposite end B formed with a rim as shown in FIG. 18A. The opening end A sometimes becomes narrower than the opposite end B after manufacturing process such as drawing as shown in FIG. 18B.

The outside diameters of the correction plate electrode are made substantially equal to the inside diameters of the cup-shaped electrode in major and minor axis lengths. Since the correction plate electrode 17*a* disposed within the anode 17 is semi-circular or semi-oval at both ends of its major axis, only top and bottom edges of the plate electrode in the minor axis direction are welded to the inner wall of the cup-shaped electrode.

When the correction plate electrode 16*a* (17*a*) is inserted into the cup-shaped electrode 16 (17) and fixed by laser weld or the like to a position of a desired set back amount d from the electrode end face to manufacture the electrode as shown in FIG. 18C, if the inside diameter of the cup-shaped electrode is of the shape shown in FIG. 18A or FIG. 18B, it is very difficult to accurately position the correction plate electrode 16*a* (17*a*) within the cup-shaped electrode (the sixth grid electrode 16 or the anode 17). Thus, it is difficult to establish the dimension d or to secure the parallelism with respect to the single opening, resulting in deterioration of characteristics of the electron gun.

As described above, in the conventional electron gun structure for the cathode ray tube, the correction plate electrode is welded by laser to a position set back from the rim in-turned internally of the opposing end faces of the cup-shaped electrode, within the cup-shaped electrode of the main lens. Therefore, variations in positioning accuracy of the correction plate electrode are caused by variations in the shape of the open end of the cup-shaped electrode, resulting in an increase of astigmatism of the lens.

There is a further problem in that it is very difficult to adjust the positioning of the correction plate electrode after being assembled and welded.

FIGS. 19A to 19C are schematic sectional views for explaining the shape of the main lens forming electrodes of the electron gun previously proposed by the present inventors. FIG. 19A is a sectional view similar to FIG. 17B illustrating the cup-shaped anode 17, FIG. 19B is a front view of the correction plate electrode 17*a* to be welded and fixed to the interior of the cup-shaped electrode 17, and FIG. 19C is an enlarged view of main parts of FIG. 19B.

As shown in FIG. 19A, the correction plate electrode 17*a* is inserted toward the opposite end formed with a rim along the inner wall B from the open end A of the cup-shaped anode 17, and fixed at its edges by laser weld or the like to the position of the set back amount d2. AS shown in FIG. 19B, the correction plate electrode 17*a* has the beam aperture 17*ac* for passing a center electron beam end two cutouts 17*as* for passing side electron beams at both its sides. The cutouts 17*as* form an electron beam aperture in cooperation with the inner wall of the anode 17.

Recesses 17*b* are formed by press-forming at the edges of the correction plate electrode 17*a* which contact the inner wall of the anode 17 when inserted into the anode 17, to reduce friction with the inner wall B and secure ease of assembling. However, when the recess 17*b* is press-formed in the correction plate electrode 17*a*, burrs 17*d* occur as shown in FIG. 19C. If the protrusion L' of the burr 17*d* is larger than the clearance between the plate electrode and the inner wall of the anode 17, this deforms the anode 17 and the correction plate electrode 17*a*.

In addition to burrs, variations of outside diameters of the correction plate electrode 17*a* and inside diameters of the open end of the cup-shaped electrode 17 hinder the ease of insertion of the correction plate electrode 17*a* into the cup-shaped electrode 17. This difficulty with the insertion and variations of conditions of laser weld change the diameter of the opening in the cup-shaped electrode and the diameters of the apertures in the correction plate electrode which play the most important role in the assembled electrodes. This poses a problem in that characteristics of the electron gun is degraded by the reduced accuracy of the main lens electrode geometry and resultant increased astigmatism such that a cathode ray tube can not provide the desired performance.

There is a further problem in that it is very difficult to readjust the position of the correction plate electrode after it is assembled and welded to the cup-shaped electrode.

The same is true for the assembly of the sixth grid electrode 16 and the correction plate electrode 16*a* therefor, and the description associated with the problem is omitted.

SUMMARY OF THE INVENTION

It is an object of the present invention to provide a color cathode ray tube of high performance in which the accuracy of a main lens electrode assembly is improved by overcoming the problems described above with respect to prior art.

For achieving the aforementioned object, according to one embodiment of the present invention, a step for controlling a set-back amount of a correction plate electrode is formed in an inner wall of a cup-shaped electrode to make easy the insertion into the cup-shaped electrode and to enable the positioning of the correction plate electrode with high accuracy. That is, there is provided an electron gun structure for a cathode ray tube which comprises a plurality of electrodes including a plurality of cathodes for emitting a plurality of in-line electron beams, a control grid having a plurality of in-line apertures centered with the plurality of cathodes, respectively, an accelerating electrode, a cup-shaped focus electrode and a cup-shaped anode fixed in predetermined axially spaced relationship and in the order named from the cathodes toward said phosphor screen, on insulating supports. Each of the cup-shaped focus electrode end the cup-shaped anode has, at a first end face thereof opposing another of the cup-shaped focus electrode and the cup-shaped anode, a single opening surrounded by a rim formed by turning in the end face thereof toward an interior thereof, has a correction plate electrode therein, and has a step on an inner wall thereof at a position set back from the first end face thereof to provide a first portion having an inside diameter larger on an open end side thereof opposite the first end face, than that of a second portion thereof on a side of the first end face. The correction plate electrode is pressed against the step and fixed to each of the cup-shaped focus and the anode.

With this constitution, it is possible to set back the correction plate electrode from the end face opposing an end face of another cup-shaped electrode for forming a main lens with accuracy, end to secure parallelism of the plate electrode with the opposing end face, to provide a cathode ray tube capable of displaying a high quality image.

Further, for achieving the aforementioned object, according to another embodiment of the present invention, a cup-shaped electrode is configured such that it is comprised of a small-inside-diameter portion on the vicinity of the end face formed with a single opening, a large-inside-diameter portion on the side of the open end and a step between the two portions, and a correction plate electrode is located within and welded to the small-inside-diameter portion at its edges. The inside diameter of the cup-shaped electrode on its open end side can be made sufficiently larger than the outside dimensions of the correction plate electrode. The correction plate electrode is inserted smoothly near the weld position without deforming the electrodes, is positioned at the predetermined location accurately within the small inside-diameter portion by using an assembling jig and is welded to the cup-shaped electrode.

Further, for achieving the aforementioned object, according to another embodiment of the present invention, the top and bottom edges of the correction plate electrode which may touch the inner wall of the cup-shaped electrode when the plate electrode is inserted into the cup-shaped electrode is sloped downward from its side edges toward the center beam aperture, in order to avoid adverse effects caused by burrs on the edges of the plate electrode, facilitate the insertion of the plate electrode and position the plate electrode accurately.

With this constitution, it is possible to establish the amount of setback of the correction plate electrode from the end face of the cup-shaped electrode facing the other cup-shaped electrode of a main lens with accuracy, and to secure the parallelism of the plate electrode with the end face, and to provide an electron gun structure for a cathode ray tube capable of displaying a high quality image.

Further, for achieving the aforementioned object, according to a further embodiment of the present invention, an outside diameter of a plate electrode is made smaller than an inside diameter of a cup-shaped electrode, protrusions are formed inwardly of the cup-shaped electrode for welding the inserted plate electrode on them. The plate electrode is easily inserted into the cup-shaped electrode and is positioned with high accuracy.

With this constitution, it is possible to establish the amount of setback of the correction plate electrode from the end face of the cup-shaped electrode facing the other cup-shaped electrode of a main lens with accuracy, and to secure the parallelism of the plate electrode with the end face, and to provide an electron gun structure for a cathode ray tube capable of displaying a high quality image.

BRIEF DESCRIPTION OF THE DRAWINGS

In the drawings, which form an integral part of the specification and are to be read in conjunction therewith, and in which like reference numerals designate similar components throughout the figures, and in which:

FIG. 1A is a sectional view in parallel with the in-line direction of three electron beams of the electron gun, FIG. 1B is a sectional view perpendicular to the in-line direction of the three electron beams;

FIG. 1C is a sectional view in parallel with the in-line direction of three electron beams of the electron gun, FIG. 1D is a sectional view perpendicular to the in-line direction of the three electron beams;

FIG. 5A is a sectional view perpendicular to the in-line direction of the three electron beams, FIG. 5B is an enlarged view of a portion A of FIG. 5A;

FIG. 6A is a sectional view of FIG. 5A, taken in the direction of the arrows VIA—VIA thereof, FIG. 6B is a sectional view of FIG. 5A, taken in the direction of the arrows VIB—VIB thereof;

FIG. 9A is a sectional view perpendicular to the in-line direction of the three electron beams, FIG. 9B is an enlarged view of a portion A of FIG. 9A;

FIG. 10 is a sectional view of FIG. 9A, taken in the direction of the arrows XA—XA thereof, FIG. 10B is a sectional view of FIG. 9A, taken in the direction of the arrows XB—XB thereof;

FIG. 13A is a sectional view perpendicular to the in-line direction of the arrangement of the three electron beams, FIG. 13B is an enlarged view of a portion A of FIG. 13A;

FIG. 14A is a sectional view perpendicular to the in-line direction of the electron beams, FIG. 14B is an enlarged view of a portion A of FIG. 14A;

FIG. 17A is a sectional view in parallel with the in-line direction of the three electron beams, and FIG. 17B is a sectional view perpendicular to the in-line direction;

FIG. 19A is a sectional view thereof, FIG. 19B is a plan view of the correction plate electrode. FIG. 19C is an enlarged view of main parts of the correction plate electrode in FIG. 19B.

DETAILED DESCRIPTION OF THE PREFERRED EMBODIMENTS

The embodiments of the present invention will be described in detail hereinafter with reference to the drawings thereof.

Figure 1A:
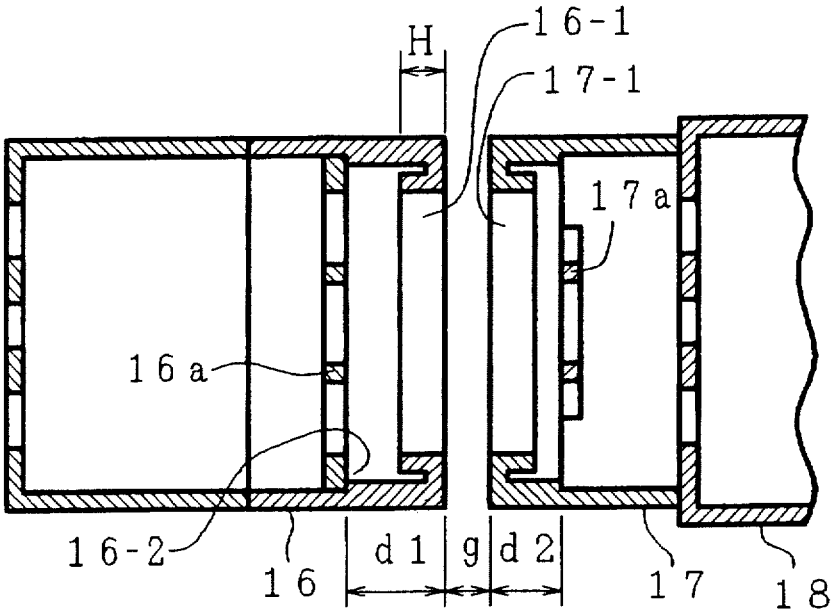
FIGS. 1A and 1B are schematic sectional views for explaining an embodiment of an electron gun structure for a cathode ray tube.
Figure 1B:
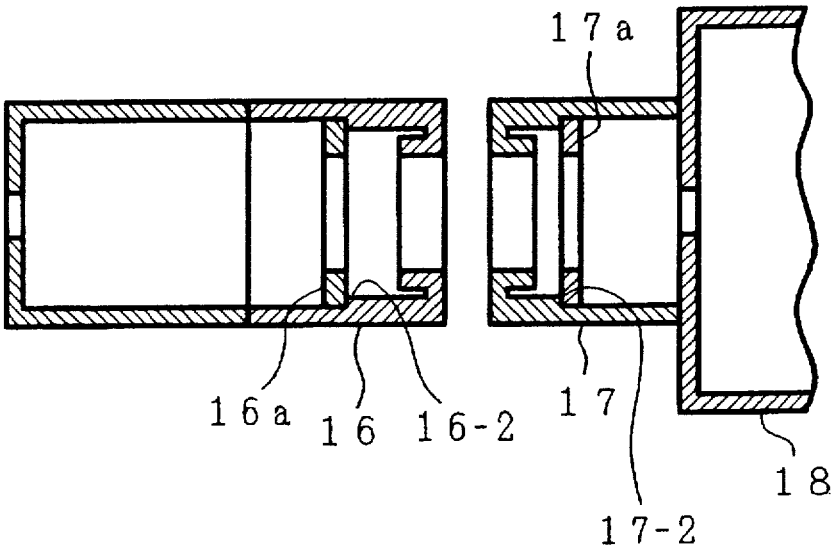

FIGS. 1A and 1B are schematic sectional views for explaining one embodiment of an electron gun for a cathode ray tube. FIG. 1A is a sectional view in parallel with the in-line direction of three electron beams, and FIG. 1B is a sectional view perpendicular to the in-line direction of the three electron beams. In FIGS. 1A and 1B, the same reference numerals as those in FIGS. 17A and 17B correspond to the same functional parts. Reference numeral 16-1 designates to a single opening formed in the end face of the sixth grid 16 opposing the anode 17, 16-2 a step formed on the inner wall of the sixth grid electrode, 17-1 a single opening formed in the end face of the anode 16 opposing the sixth grid electrode, and 17-2 a step formed on the inner wall of the anode.

In FIGS. 1A and 1B, a main lens is formed between the opposing end faces of the sixth grid electrode 16 and the anode 17. An in-turned rim is formed in the end face of the sixth grid electrode 16 opposing the anode 17, and similarly, an in-turned rim is formed in the end face of the anode 17 opposing the sixth grid electrode 1*h*. The single-openings 16-1 and 17-1 in the sixth grid electrodes and the anode oppose each other and form a main lens therebetween. Interiorly of the sixth grid electrode 16, a correction plate electrode 16*a* is positioned at a place set back a predetermined distance from its end face opposing the anode 17.

The correction plate electrode 16*a* is positioned by pressing it against the step 16-2 formed within the sixth grid electrode 16 and is welded to the sixth grid electrode 16. The step 16-2 is formed by enlarging the inside diameter of the sixth grid electrode 16. Also interiorly of the anode 17, a correction plate electrode 17*a* is positioned at a place set back a predetermined distance set back from its end face opposing the sixth grid electrode 16.

Figure 2:
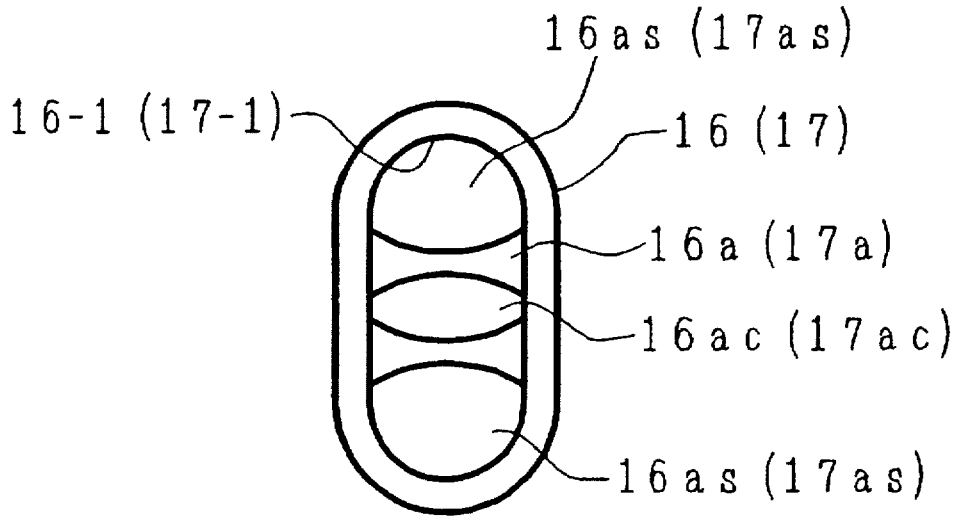
FIG. 2 is a front view showing a state in which a correction plate electrode is welded to the interior of the cup-shaped electrode of FIG. 1A.

The correction plate electrode 17*a* is positioned by pressing it against the step 17-2 formed within the anode 17 and is welded to the anode 17. The step 17-2 is formed by enlarging the inside diameter of the anode 17. FIG. 2 is a plan view showing a state in which a correction plate electrode is welded to the interior of the cup-shaped electrode, as viewed from the rim side of the sixth grid electrode or the anode.

In FIG. 2, the correction plate electrode 16*a* (17*a*) welded interiorly of the cup-shaped electrode (sixth grid electrode 16, anode 17) is formed with three electron beam apertures 16*as* (17*as*), 16*ac* (17*ac*) and 16*as* (17*as*) adjacent to but spaced from the single opening 16-1 (17-1) in the cup-shaped electrode. This main lens structure provides a large-diameter lens.

Figure 3:
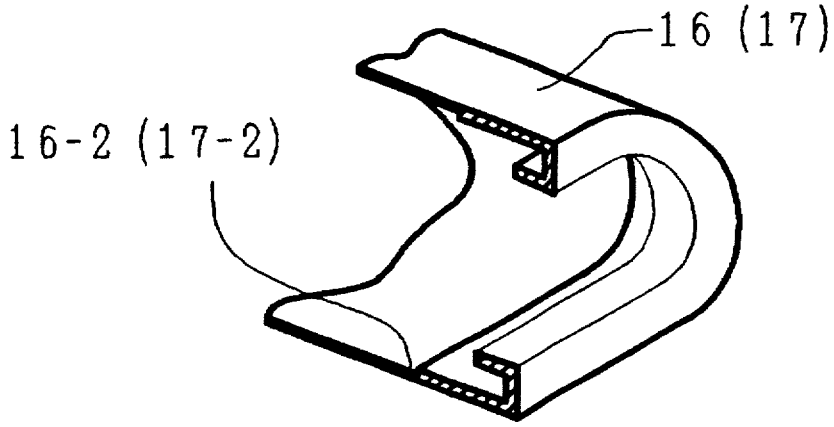
FIG. 3 is a fragmentary perspective view showing a step for welding the correction plate electrode to the interior of the cup-shaped electrode of FIG. 1A.

FIG. 3 is a fragmentary perspective view showing a step provided for positioning the correction plate electrode in the interior of the cup-shaped electrode. The steps 16-2 and 17-2 are formed by enlarging the inside diameters of the cup-shaped sixth grid electrode 16 and the anode 17. The steps can be formed simultaneously with the press-forming of the cup-shaped electrode.

Figure 4A:
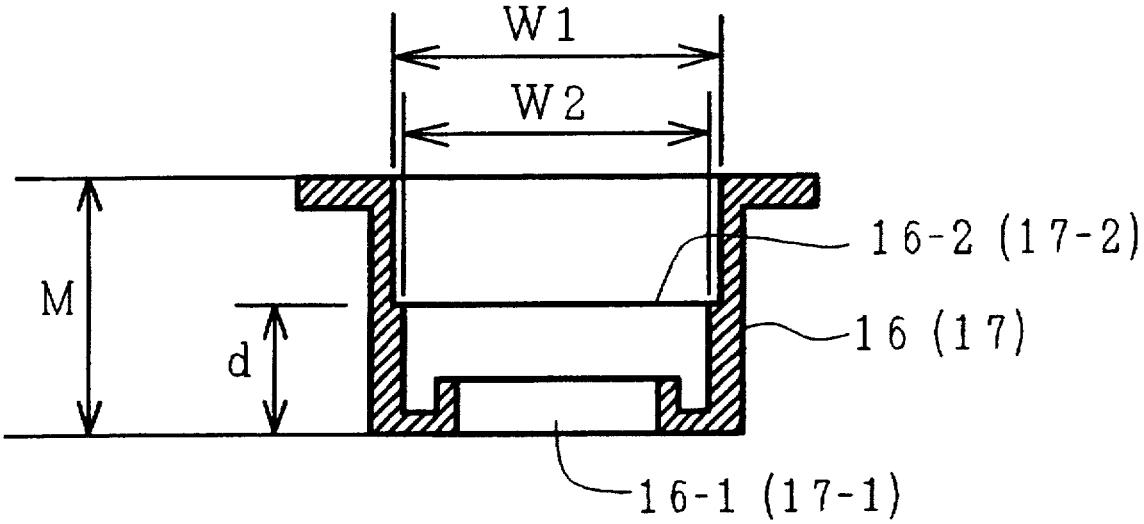
FIG. 4A is an axial sectional view of an electron gun showing a step for welding the correction plate electrode to the interior of the cup-shaped electrode of FIG. 1A.

FIG. 4A is an axial sectional view of an electron gun showing a step for positioning the correction plate electrode in the interior of the cup-shaped electrode. In FIG. 4A, the correction plate electrode is omitted.

In FIG. 4A, the step 16-2 (17-2) is formed at a position set back by "d" in an axial direction from its end face which is opposing the other cup-shaped electrode and which is formed with a rim. This step enables the inside diameter W1 at the open end opposite the end face formed with a rim to be larger than the inside diameter W2 in the vicinity of the end face opposing the other cup-shaped electrode to facilitate the insertion of the correction plate electrode into the cup-shaped electrode, establishes the amount "d" of the setback with accuracy.

In FIG. 4A, as a specific example, the height M and the set back amount d are 7 mm and 3.5 mm, respectively, W1−W2=0.04 mm.

In the embodiment illustrated in FIGS. 1A and 1B, the correction plate electrodes 16*a* and 17*a* are positioned by pressing them against the step 16-2 formed within the sixth grid electrode 16 and the step 17-2 formed within the anode 17, and are welded to the sixth grid electrode and the anode 17, respectively. But it is not essential for the present invention to position the correction plate electrodes 16*a* and 17*a* by using the steps 16-2 and 17-2, respectively.

Figure 1C:
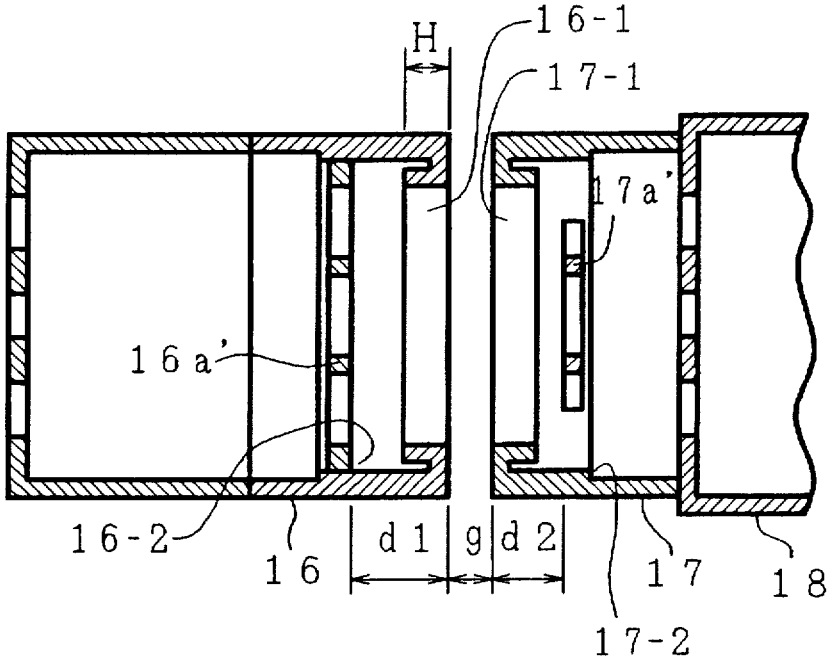
FIGS. 1C and 1D are schematic sectional views for explaining a modification of the embodiment of FIGS. 1A and 1B.
Figure 1D:
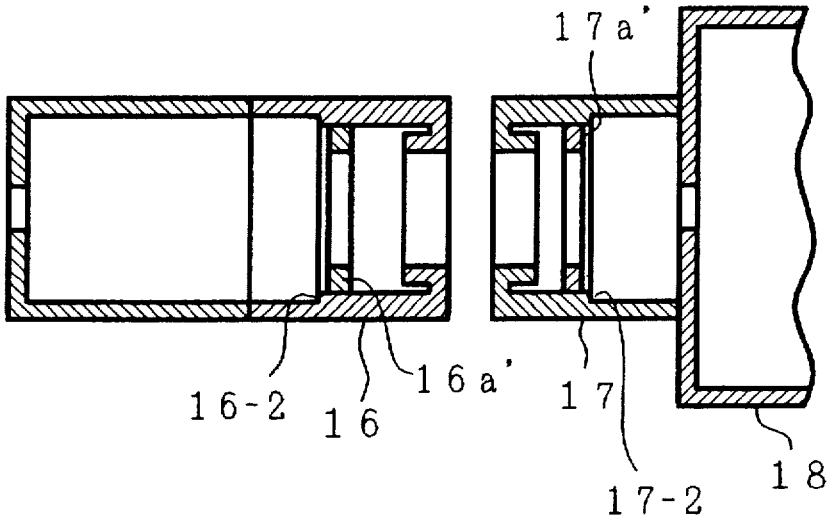
Figure 4B:
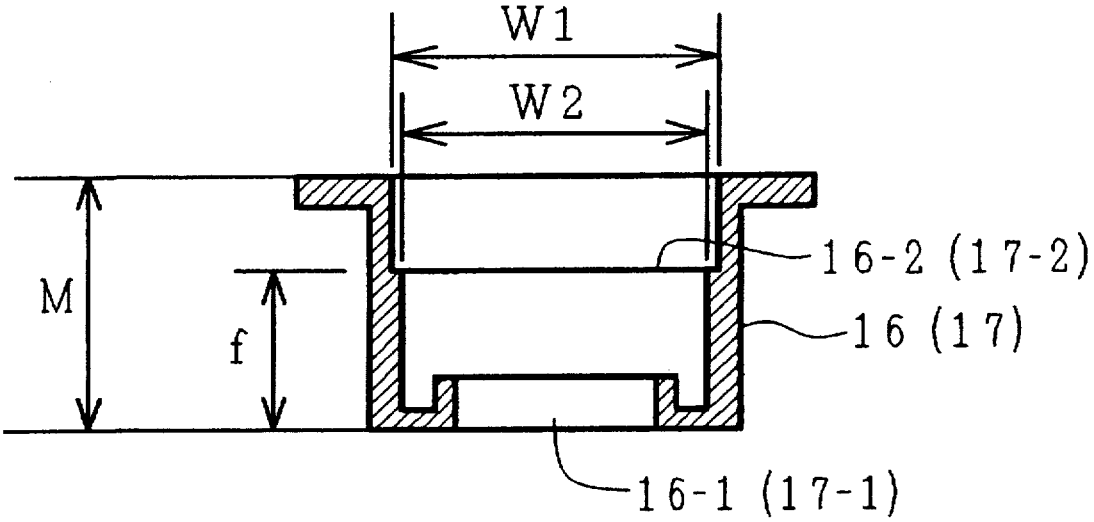
FIG. 4B is an axial sectional view of an electron gun showing a step in the interior of the cup-shaped electrode of FIG. 1C.

A modification of the embodiment shown in FIGS. 1A and 1B will be described with reference to FIGS. 1C, 1D and 4B. FIG. 1C is a sectional view in parallel with the in-line direction of three electron beams of the electron gun for a cathode ray tube, FIG. 1D is a sectional view perpendicular to the in-line direction of the three electron beams, and FIG. 4B is an axial sectional view of the cup-shaped sixth grid electrode 16 and the cup-shaped anode 17. In FIG. 4B, a region having an inside diameter W2 extends from the end face formed with a single opening 16-1 (17-1) to a distance f which is greater than the distance d1 or d2 indicated in FIG. 1C. In FIG. 1C, the correction plate electrode 16*a*' is inserted beyond the step 16-2 into a region having the inside diameter W2 and is welded by a laser at a distance of d1 from the single opening 16-1 and the correction plate electrode 17*a*' is inserted beyond the step 17-2 into a region having the inside diameter W2 and is welded by laser at a distance of d2 from the single opening 17-1. In this case the outer dimensions of the correction plate electrodes 16*a*, and 17*a*' are made smaller than those of the correction plate electrodes 16*a* and 17*a* in the embodiment illustrated in FIGS. 1A and 1B. The dimensions M, W1 and W2 in FIG. 4B are the same as in FIG. 4A. The dimension f in FIG. 4A is 4.1 mm. The thickness of the correction plate electrodes 16*a*, and 17*a*' is 0.6 mm.

In this modification, the inside diameter W1 of the cup-shaped sixth grid electrode 16 and the cup-shaped anode 17 on their open end side can be made sufficiently larger than the outer dimensions of the correction plate electrodes 16*a*, and 17*a*', and the correction plate electrodes can be inserted smoothly into the vicinity of their weld positions without deforming the electrodes, and are welded to the sixth grid electrode 16 and the anode 17 at predetermined positions in a region having the inside diameter W2 after they are positioned accurately by using an electrode assembling jig.

According to the above-described embodiment, it is possible to provide precision main lens electrodes for an electron gun structure for a high performance cathode ray tube.

The present invention can be applied to not only the above-described main lens electrodes but also various electrodes for an electron gun including other similar electrodes therein.

According to the present invention, the assembly of the correction plate electrodes in the electrode of the type in which the correction plate electrodes are inserted into and fixed to the cup-shaped electrode becomes easy and the positioning of the correction plate electrodes can be established with high accuracy, thus a cathode ray tube of high image quality is provided.

Figure 5A:
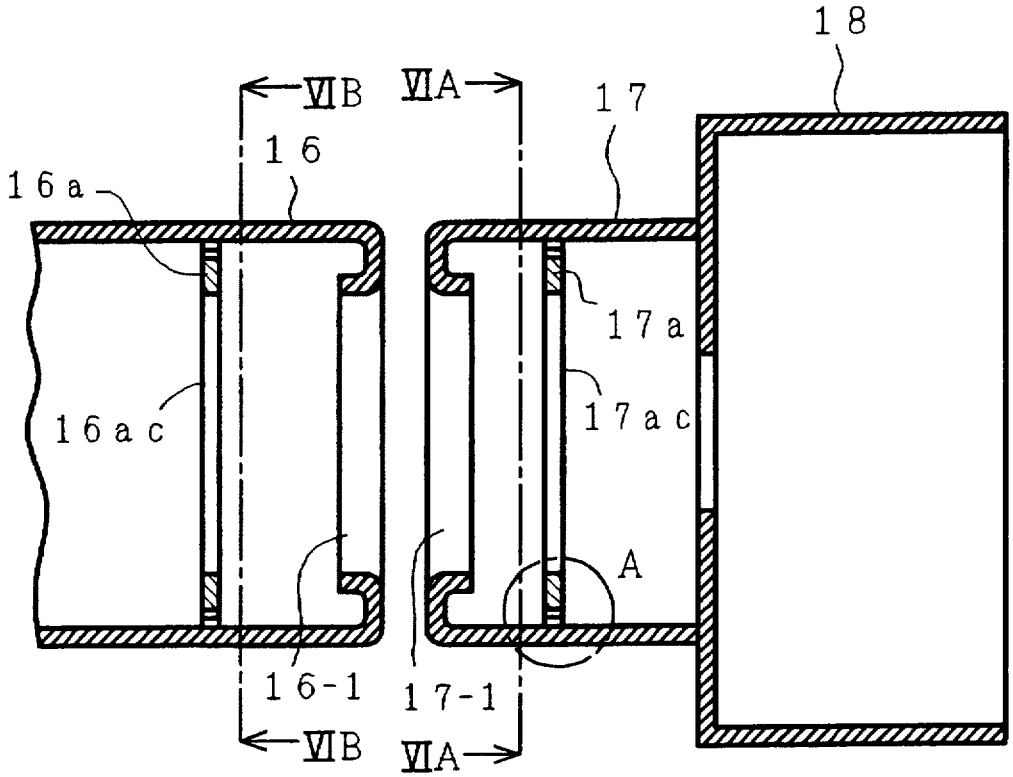
FIGS. 5A and 5B are schematic sectional views for explaining another embodiment of an electron gun structure for a cathode ray tube according to the present invention.
Figure 5B:
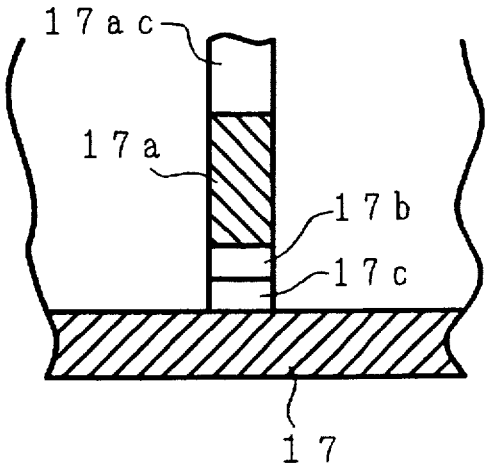

FIGS. 5A and 5B are schematic sectional views for explaining a further embodiment of an electron gun structure for a color cathode ray tube according to the present invention, FIG. 5A is a sectional view perpendicular to the in-line direction of the three electron beams, and FIG. 5B is an enlarged view of the encircled portion designated at A of FIG. 5A.

In FIGS. 5A and 5B, the same reference numerals as those in FIGS. 17A, 17B, 19A, 19B and 19C correspond to the same functional parts. Reference numeral 17*b* designates a recess, and 17*c* designates a sloping portion described later. While FIGS. 5A and 5B illustrate the constitution of the anode 17, the same is true for the sixth grid electrode 16.

In FIGS. 5A and 5B, the end face of the sixth grid electrode 16 facing the anode 17 is turned in to form a rim, and similarly, the end face of the anode 17 facing the sixth grid electrode 16 is also formed with a rim. The single openings 16-1 and 17-1 face each other to form a main lens therebetween.

As explained in connection with FIGS. 17A and 17B, interiorly of the sixth grid electrode 16 is installed the correction plate electrode 16*a* with a desired amount of set back from its end face opposing the anode 17, and interiorly of the anode 17 is installed the correction plate electrode 17*a* with a desired amount of set beck from its end face opposing the sixth electrode 16.

The correction plate electrode installed in the cup-shaped electrode has the shape as described below. Take the anode 17 and the correction plate electrode 17*a*, for instance, the correction plate electrode 17*a* installed within the anode 17 has a recess 17*b* for facilitating the insertion into the cup-shaped electrode and a sloping portion 17*c* described later to avoid difficulties in insertion caused by burrs.

Figure 6A:
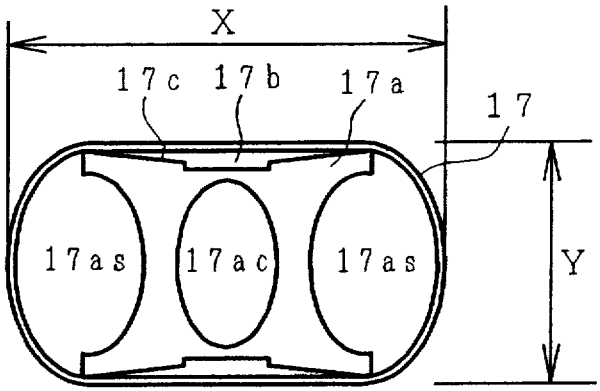
FIGS. 6A and 6B are front views showing the constitution of the cup-shaped electrode of FIG. 5A and a plate-like electrode inserted therein.
Figure 6B:
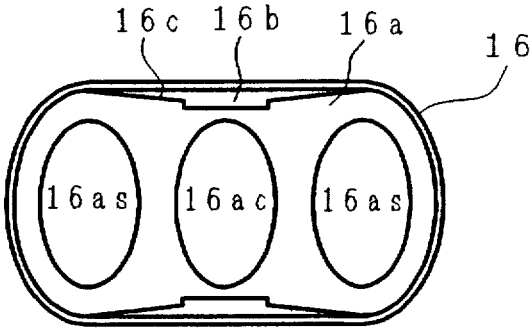

The correction plate electrode 17*a* is inserted into a desired position of the anode 17 and welded and fixed by laser or the like. FIGS. 6A and 6B are views showing the constitution of the cup-shaped electrode of FIG. 5A and a correction plate electrode inserted therein, FIG. 6A is a sectional view of FIG. 5A, taken in the direction of the arrows VIA—VIA thereof, and FIG. 6B is a sectional view of FIG. 5A, taken in the direction of the arrows VIB—VIB thereof.

In FIG. 6A, the correction plate electrode 17*a* housed in the anode 17 has a center electron beam aperture 17*ac* and side electron beam apertures 17*as*. The recesses 17*b* are formed above and below the center electron beam apertures 17*ac* in the center portion of the plate electrode, and the correction plate electrode has four sloping edges 17*c* which approach the edges of the center electron beam aperture in the in-line direction of the three electron beams from the corners of the plate electrode.

The correction plate electrode 16*a* housed in the sixth grid electrode 16 likewise has a center electron beam aperture 16*ac* and side electron beam apertures 16*as*, as shown in FIG. 6B. The recesses 16*b* are formed above and below the center electron beam apertures 16*ac* in the center portion of the plate electrode, end the correction plate electrode has four sloping edges 16*c* which approach the edges of the center electron beam aperture in the in-line direction of the three electron beams from the corners of the plate electrode.

Figure 7:
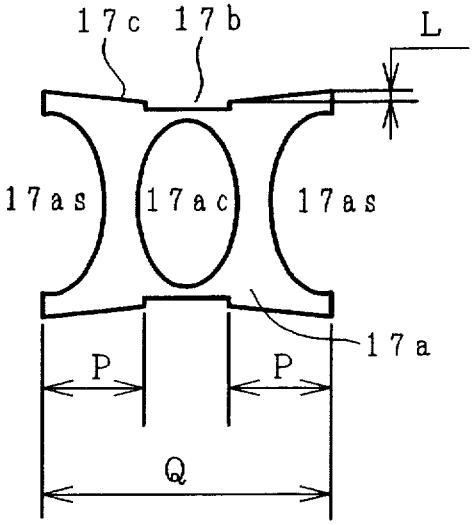
FIG. 7 is a plan view for explaining in detail the shape of a correction plate electrode installed within the cup-shaped electrode of FIG. 6A.
Figure 8:
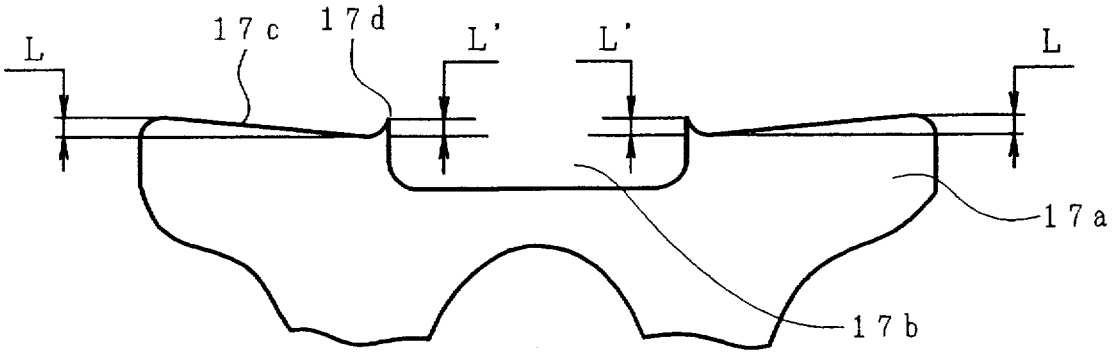
FIG. 8 is an enlarged plan view of main parts of the correction plate electrode of FIG. 7.

FIG. 7 is a plan view for explaining in detail the shape of a correction plate electrode installed within the cup-shaped electrode of FIG. 6A. A description will be made taking the plate electrode 17*a* installed on the anode 17 of FIG. 6A as an example. FIG. 8 is an enlarged plan view of main parts of FIG. 7.

In FIGS. 6A, 7 and 8, the correction plate electrode 17*a* is formed at the edge thereof with recesses 17*b* as well as sloping edges 17*c*. As shown enlarged in FIG. 8, the sloping edges 17*c* slope gradually downward to the recesses 17*b* from both ends of the edge of the plate electrode by a height L exceeding a height L, of burrs caused in press-forming, that is, the height L of the corners of the plate electrode and the height L' of the burrs measured in a direction perpendicular to the three beam in-line direction with respect to the mouth of the recesses satisfy the relationship $L' \leqq L$.

Specific dimensions are as follows:

the dimensions X, Y of the anode 17 in FIG. 6A are 22 mm and 16 mm, respectively; the dimensions P, Q of the correction plate electrode 17 in FIG. 7 are 4 mm, 12 mm, respectively; and a value L of 10 μm is chosen for the plate electrode of a thickness in the range of 0.3 mm to 1.0 mm. It has been found that the value L of 15 μm or less is sufficient.

With this structure, it is possible to prevent the anode 17 or the plate electrode 17*a* from being deformed due to the burrs 17*d* when the correction plate electrode 17 is inserted into the anode 17. In case of assembling the sixth grid electrode 16 and the plate electrode 16*a*, deformation of the sixth grid electrode 16 and the plate electrode 16*a* are likewise prevented by the provision of the sloping portion.

It is possible to provide a high performance cathode ray tube having precision main lens electrodes according to the above-described embodiment. Of course, the present embodiment can be combined with the embodiments explained in connection with FIGS. 1A to 4B.

It is noted that the present invention can be applied not only to the aforementioned main lens electrodes but also to various electron gun electrodes having similar internal electrodes.

According to the present invention, it becomes easy to assemble the correction plate electrode into the electrode of the type in which the correction plate electrode is inserted into and fixed to the cup-shaped electrode, and it is possible to establish the position of the correction plate electrode with high accuracy, thus a high quality cathode ray tube can be provided.

Figure 9A:
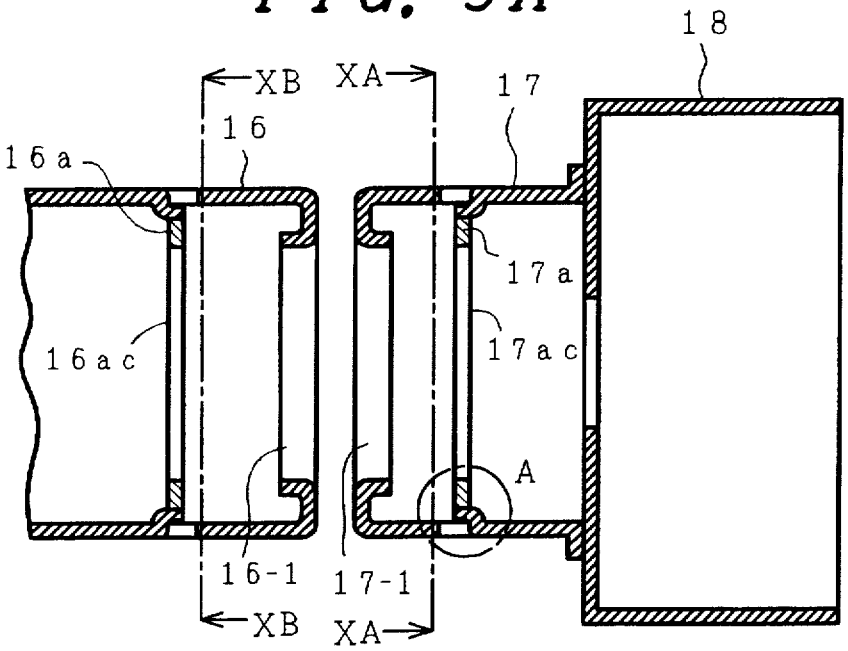
FIGS. 9A and 9B are schematic sectional views for explaining another embodiment of an electron gun structure for a cathode ray tube according to the present invention.
Figure 9B:
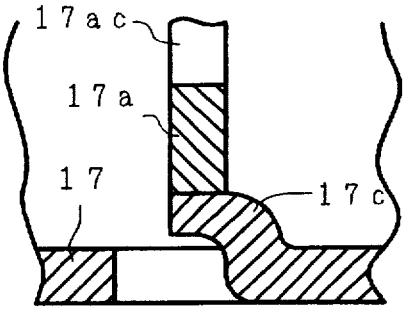

FIGS. 9A and 9B are schematic sectional views for explaining another embodiment of an electron gun structure for a cathode ray tube according to the present invention, FIG. 9A is a sectional view perpendicular to the in-line direction of the three electron beams, and FIG. 9B is an enlarged view of the encircled portion designated A of FIG. 9A.

Figure 17A:
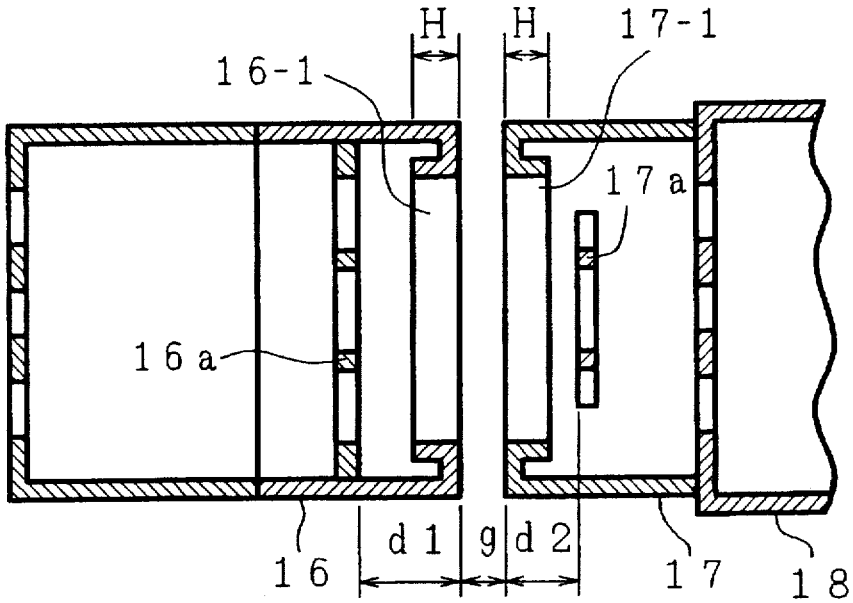
FIG. 17A (PRIOR ART)
FIGS. 17A and 17B are schematic sectional views for explaining a main lens forming electrode of an electron gun.
Figure 17B:
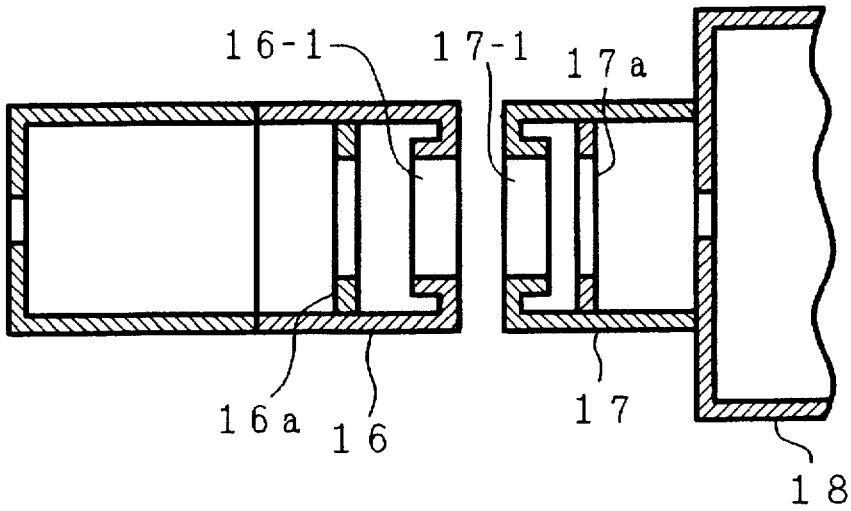
FIG. 17B (PRIOR ART)
Figure 18A:
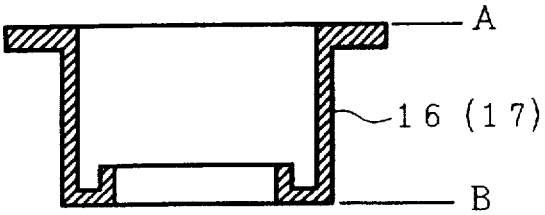
FIG. 18A (PRIOR ART)
FIGS. 18A to 18C are schematic sectional views for explaining various shapes of a main lens forming electrode of a conventional electron gun.
Figure 18B:
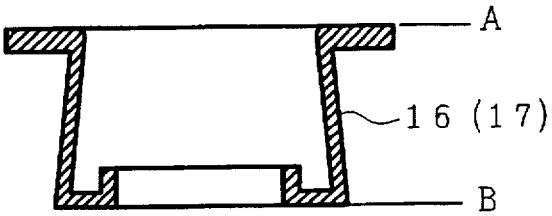
FIG. 18B (PRIOR ART)
Figure 18C:
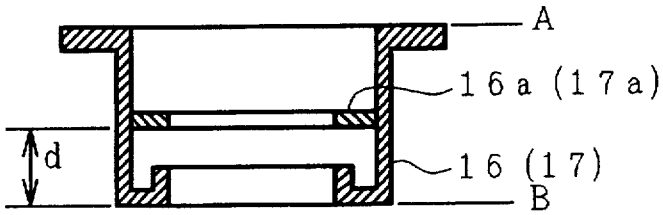
FIG. 18C (PRIOR ART)
Figure 19A:
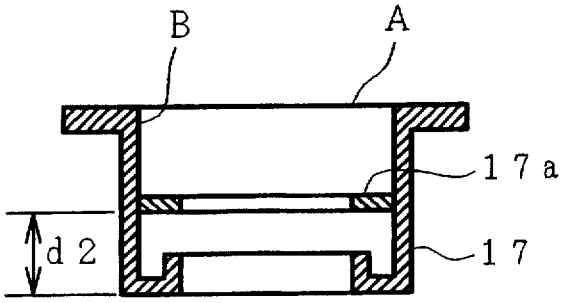
FIGS. 19A to 19C are views for explaining the shape of a main lens forming electrode of an electron gun previously proposed by the present inventor.
Figure 19B:
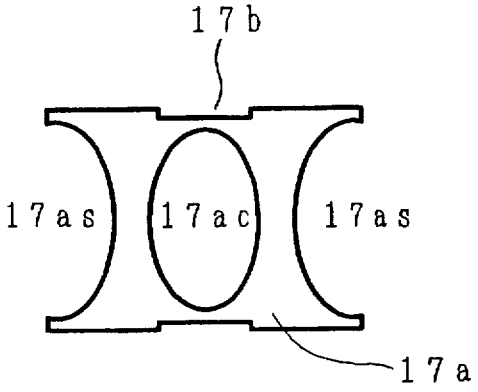
Figure 19C:
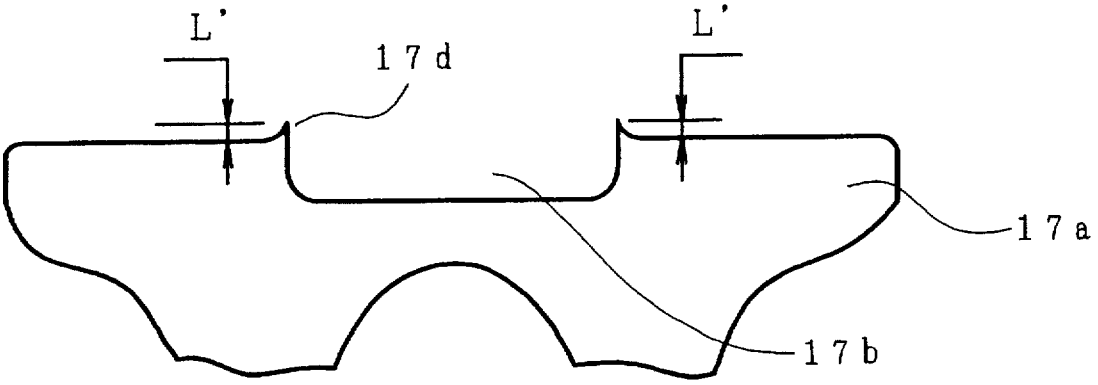

In FIGS. 9A and 9B, the same reference numerals as those in FIGS. 17A and 17B correspond to the same functional parts. Reference numeral 17*c* designates tongues. While FIGS. 9A and 9B show the constitution of welding portions of the correction plate electrode 17*a* inserted into the anode 17, it is to be noted that the correction plate electrode 16*a* inserted into the sixth grid electrode 16 is also provided with tongues similar to those formed in the electrode 17 except the correction plate electrode is provided with three electron beam apertures.

In FIG. 9A, the end face of the sixth grid electrode 16 opposing the anode 17 is turned in to form a rim, the end face of the anode 17 opposing the sixth grid electrode is turned in to form a rim, the two single openings 16-1 and 17-1 of the two cup-shaped electrodes face each other and form a main lens therebetween.

As explained in connection with FIG. 17A, the correction plate electrode 16*a* is provided within the sixth grid electrode 16 with a desired amount of set back from its end face opposing the anode 17, and the correction plate electrode 17*a* is provided within the anode 17 with a desired amount of set back from its end face opposing the sixth electrode 16.

Tongues 17*c* are drawn integrally from the electrode material and configured to project inwardly and axially on the wall surface of the cup-shaped anode 17 extending in the in-line direction of the three electron beams. Two tongues 17*c* are arranged in a line corresponding to each of two sides of the correction plate electrode parallel with the in-line direction as described later.

The correction plate electrode installed in the cup-shaped electrode has a shape as described below. Taking the anode 17 and the correction plate electrode 17*a* as an example, the correction plate electrode 17*a* installed within the anode 17 has the outside diameter slightly smaller than the inside diameter of the anode 17 to facilitate the insertion thereof in assembling.

The top and bottom edges of the correction plate electrode 17*a* are positioned to oppose the tongues 17*c* on the inner wall of the anode 17 and welded to the tongues by laser or the like.

Figure 10A:
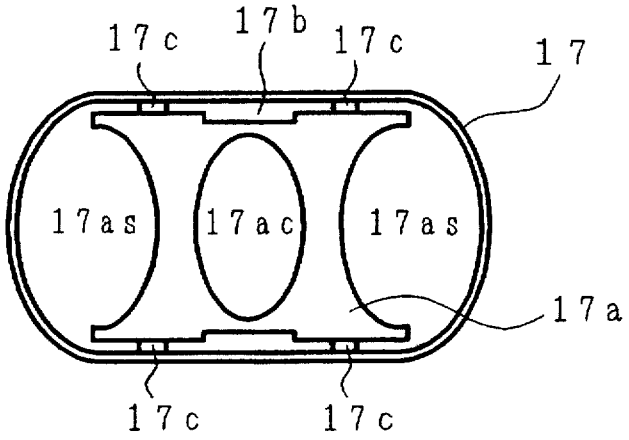
FIG. 10A and 10B are front views showing the constitution of the cup-shaped electrode and a plate-like electrode inserted therein.
Figure 10B:
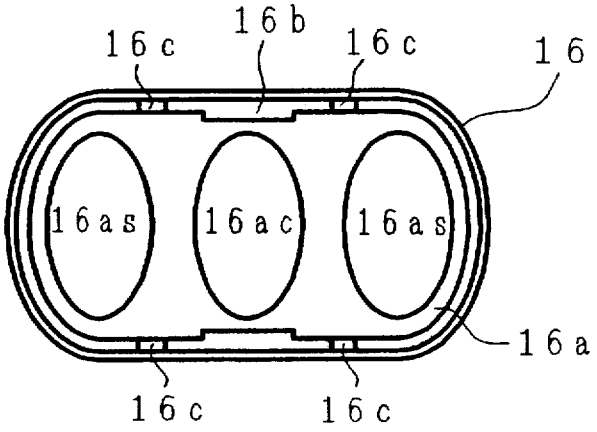

FIG. 10A and 10B are views showing the constitution of the cup-shaped electrodes and correction plate electrode inserted therein. FIG. 10A is a sectional view of FIG. 9A, taken in the direction of the arrows XA—XA thereof, and FIG. 10B is a sectional view of FIG. 9A, taken in the direction of the arrows XB—XB thereof.

In FIG. 10A, the correction plate electrode 17*a* housed in the anode 17 has a center electron beam aperture 17*ac* and side electron beam apertures 17*as*, and the recesses 17*b* are formed above and below the center electron beam apertures 17*ac* in the center portion of the plate electrode, and the sides of the plate electrode parallel with the in-line direction of the electron beams are welded to the tongues 17*c* formed in the inner walls of the anode 17.

The plate electrode 16*a* housed in the sixth grid electrode 16 likewise has a center electron beam aperture 16*ac* and side electron beam apertures 16*as*, as shown in FIG. 10B, and the recesses 16*b* are formed above and below the center electron beam apertures 16*ac* in the center portion of the plate electrode, and the sides of the plate electrode parallel with the in-line direction of the electron beams are welded to the tongues 16*c* formed in the inner walls of the sixth grid electrode 16.

Figure 11:
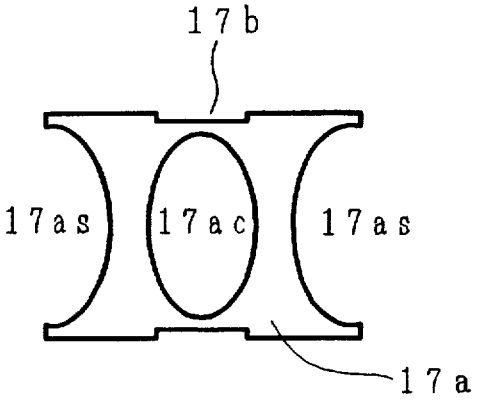
FIG. 11 is a plan view for explaining in detail the shape of a correction plate electrode installed within the cup-shaped electrode of FIG. 10A.
Figure 12:
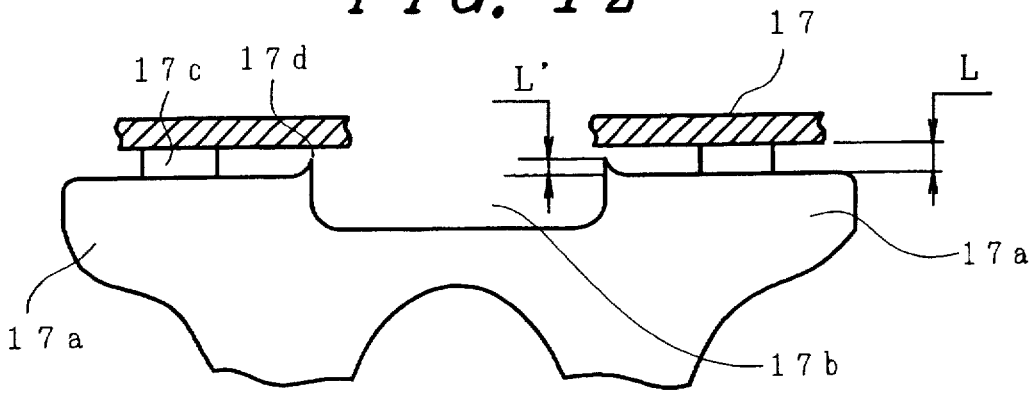
FIG. 12 is an enlarged plan view of main parts of the correction plate electrode of FIG. 11.

FIG. 11 is a plan view for explaining the shape of a correction plate electrode according to the present embodiment installed within the cup-shaped electrode, taking the correction plate electrode 17*a* installed on the anode 17 of FIG. 10A as an example. FIG. 12 is an enlarged view of main parts of FIG. 11.

In FIGS. 11 and 12, the sides of the correction plate electrode 17 parallel with the in-line direction are formed with a recess 17*b*. The amount of projection of the tongues 17*c* formed on the inner wall of the anode 17 is formed so that the clearance L between the inner wall of the anode and the mouth of the recesses 17*b* exceed the height L, of burrs caused when the recesses 17*b* are press-formed, to satisfy $L' \leqq L$.

Also in this case, L of 10 to 15 μm is sufficient like in the previous embodiment.

With this structure, deformation of the anode 17 or the plate electrode 17*a* caused by the contact of the burrs 17*d* with the inner wall of the anode when the correction plate electrode 17*a* is inserted along the inner wall of the anode 17 can be prevented.

Also with respect to an assembly of the sixth grid electrode 16 and the correction plate electrode 16*a*, deformation of the sixth grid electrode 16 or the correction plate electrode 16*a* can be likewise prevented. The width in the in-line direction of the correction plate electrode 16*a* is also formed to be slightly smaller than the corresponding inside diameter of the sixth grid electrode 16.

According to the above-described embodiment, it is possible to provide precision main lens electrodes for an electron gun for a high performance cathode ray tube.

Figure 13A:
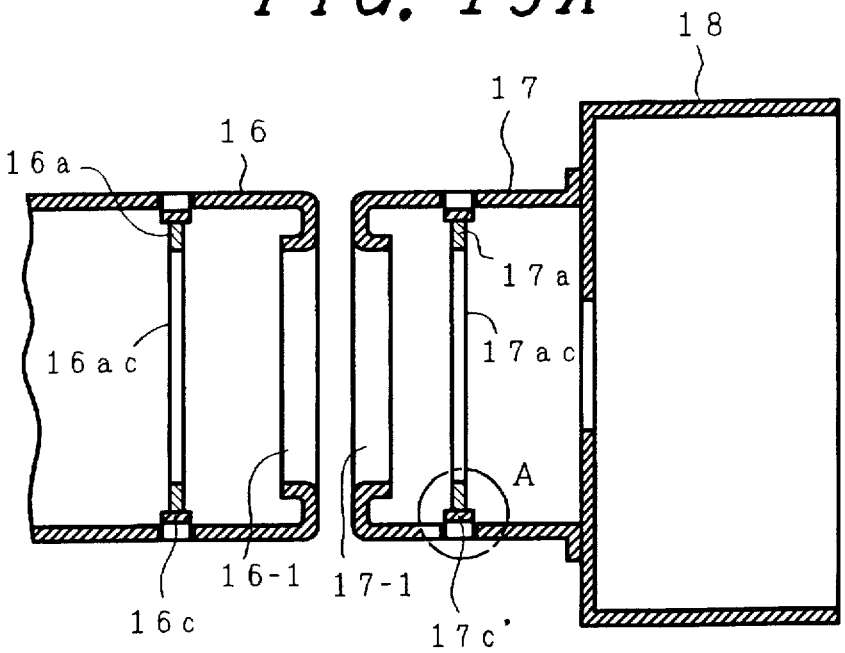
FIGS. 13A and 13B are schematic sectional views for explaining another embodiment of an electron gun structure for a cathode ray tube according to the present invention.
Figure 13B:
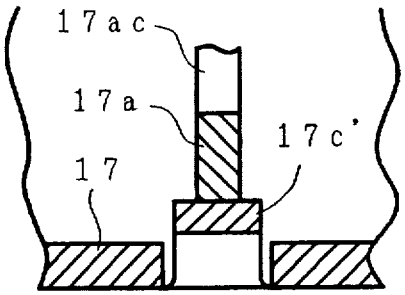

FIGS. 13A and 13B are schematic sectional views for explaining another embodiment of an electron gun structure for a cathode ray tube according to the present invention, FIG. 13A is a sectional view perpendicular to the in-line direction of the arrangement of the three electron beams, and FIG. 13B is an enlarged view of a portion A of FIG. 13A.

In FIGS. 13A and 13B, the same reference numerals as those in FIG. 9A correspond to those of the same functional parts in FIG. 9A. Reference numeral 17*c*' designates tongues. While FIGS. 13A and 13B show the constitution of welding portions of the correction plate electrode 17*a* inserted into the sixth grid electrode 17, it is to be noted that the sixth grid electrode 16 is also provided with tongues similar to those formed in the anode 17 except that the correction plate electrode 16*a* inserted in the sixth grid electrode 16 is provided with three electron beam apertures.

The projection formed on the inner wall of the cup-shaped electrode in this embodiment is tongues 17*c*' configured to project inwardly and perpendicularly to the tube axis and drawn integrally from the electrode material. The correction plate electrode 17*a* is welded and fixed to the tongues 17*c*' by laser. Other constitutions are similar to those of the previous embodiment.

Also in this embodiment, it is possible to provide precision main lens electrodes for an electron gun for a high performance cathode ray tube.

Figure 14A:
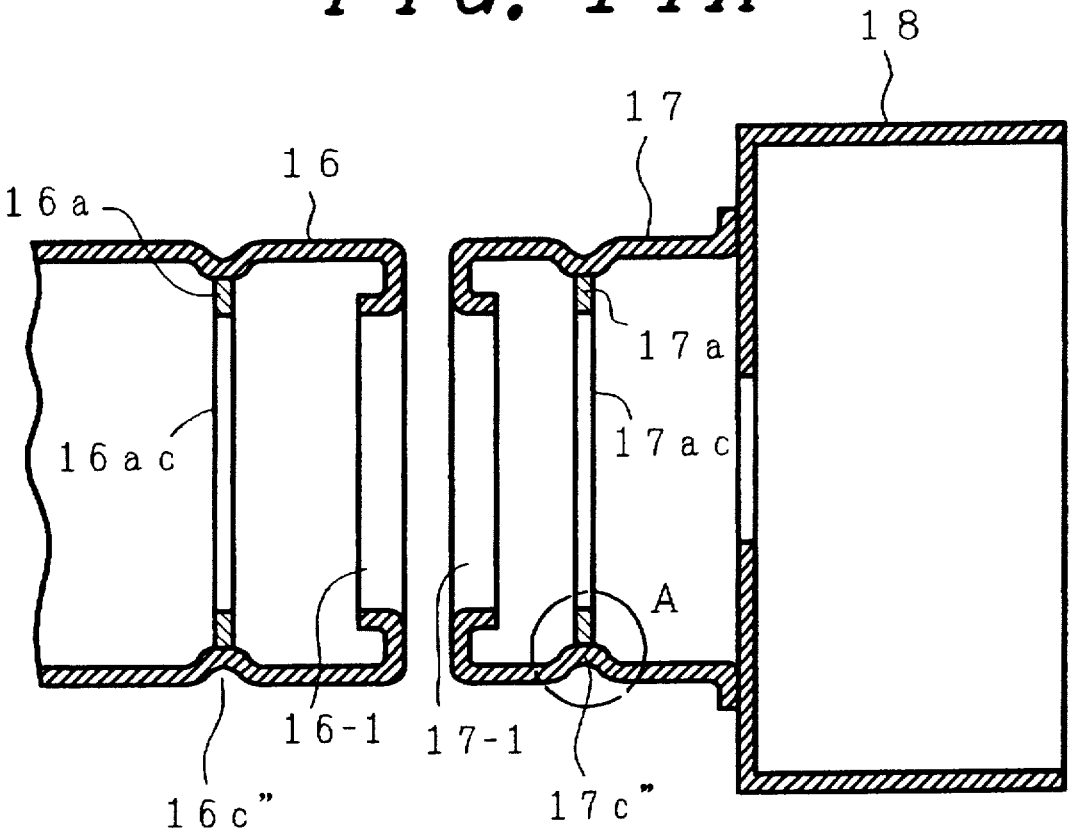
FIGS. 14A and 14B are schematic sectional views for explaining still another embodiment of an electron gun structure for a cathode ray tube according to the present invention.
Figure 14B:
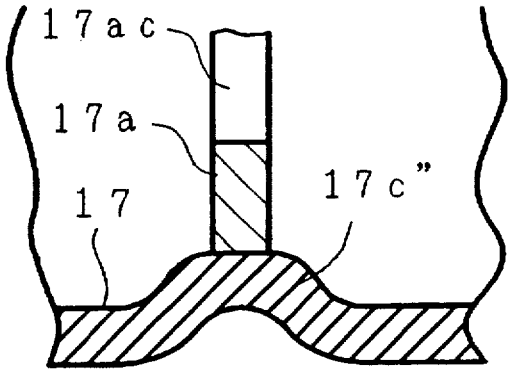
Figure 15:
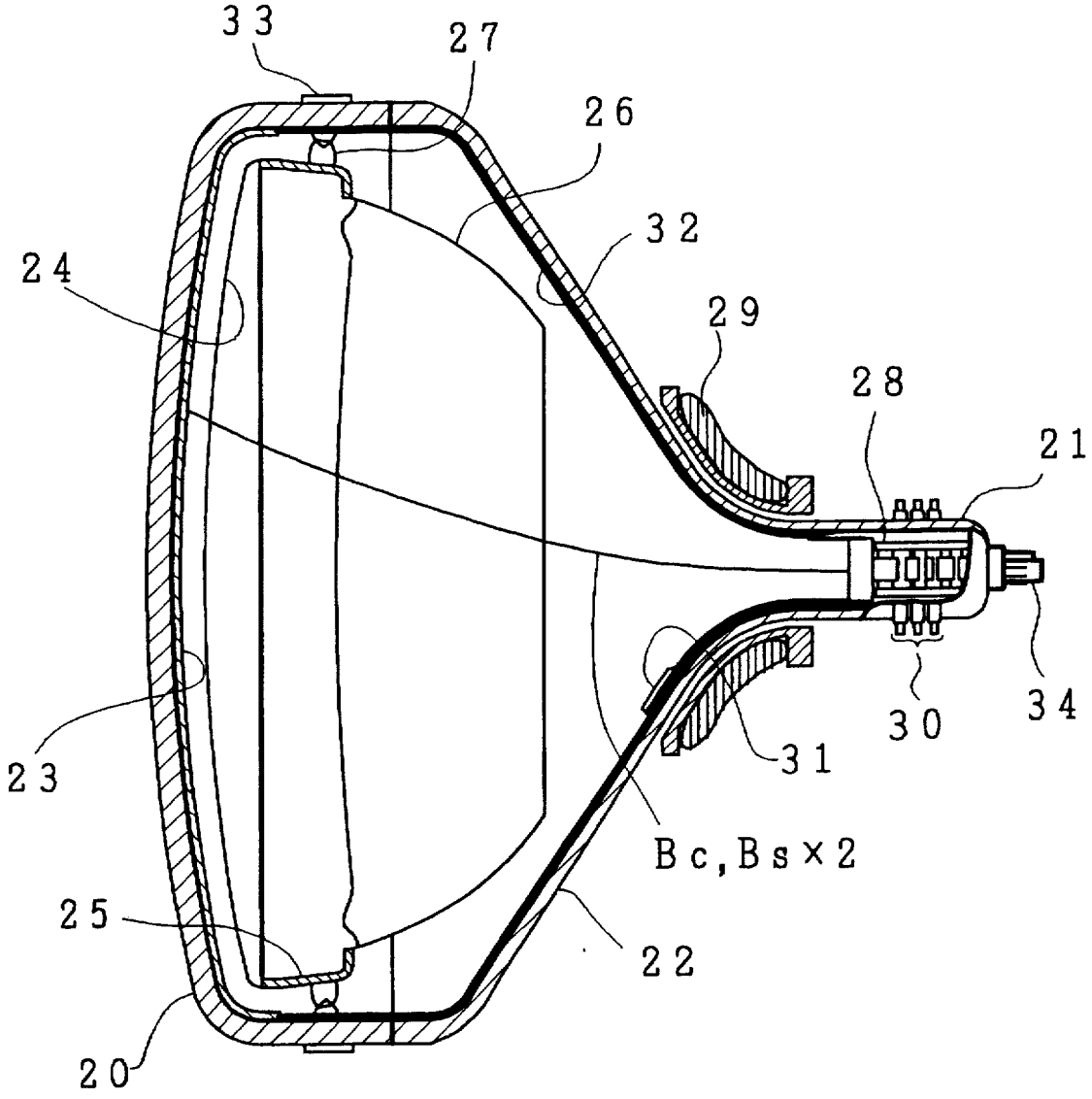
FIG. 15 is a schematic sectional view for explaining the constitution of a shadow mask type color cathode ray tube as one example of a color cathode ray tube to which the present invention is applied.
Figure 16:
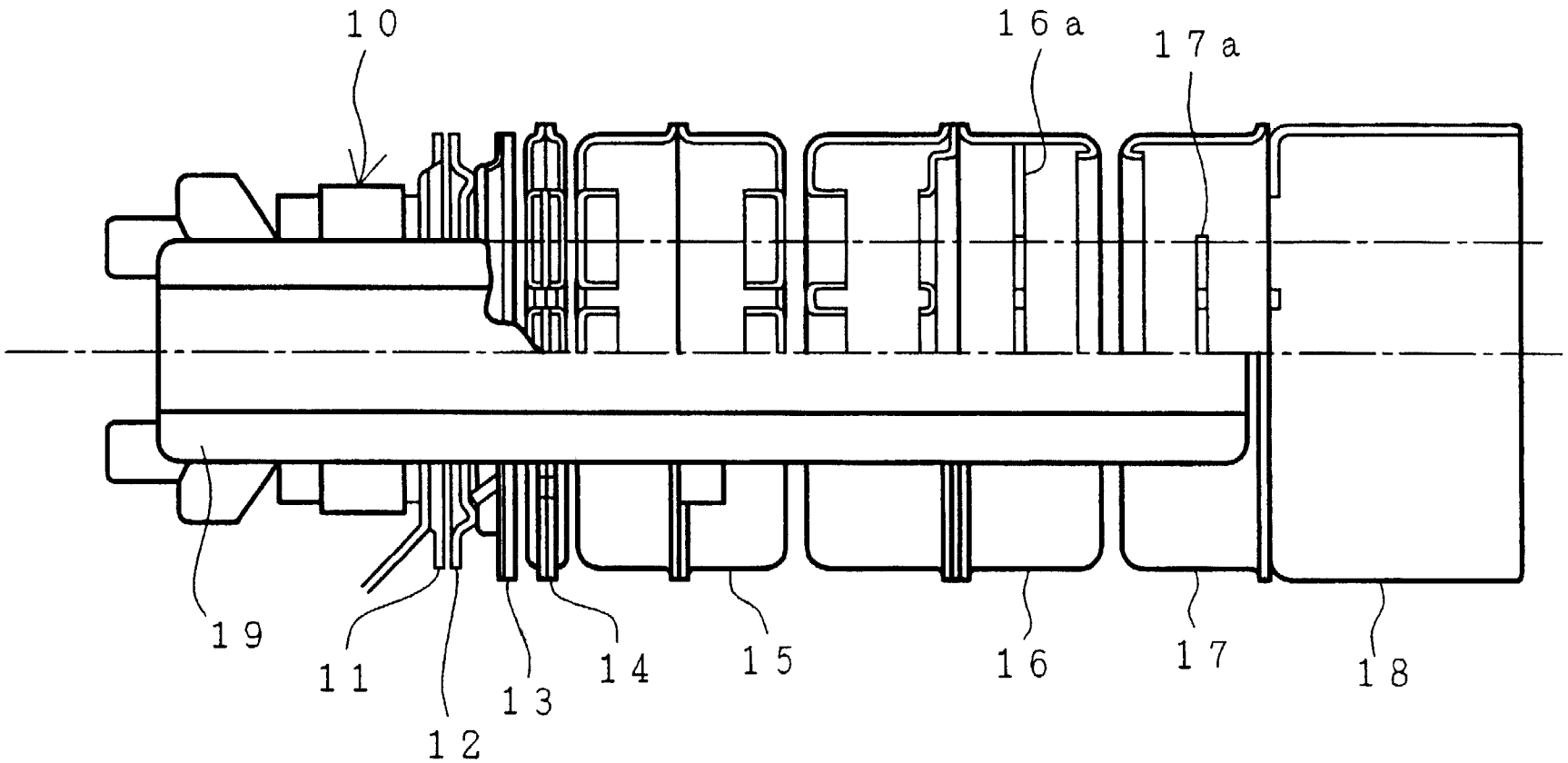
FIG. 16 (PRIOR ART)
FIG. 16 is a side view of main parts for explaining a structural example of an in-line type electron gun structure used in the color cathode ray tube shown in FIG. 15.

FIGS. 14A and 14B are schematic sectional views for explaining still another embodiment of an electron gun structure for a cathode ray tube according to the present invention, FIG. 14A is a sectional view perpendicular to the in-line direction of the three electron beams, and FIG. 14B is an enlarged view of a portion A of FIG. 14A.

In FIGS. 14A and 14B, the same reference numerals as those in FIGS. 9A and 9B correspond to the same functional parts. Reference numeral 17*c*" designates projections. While FIGS. 14A and 14B show the constitution of welding portions of the correction plate electrode 17*a* inserted into the anode 17, it is to be noted that the sixth grid electrode 16 is also provided with projections 16*c*" similar to those formed on the anode 17 except that the correction plate electrode is provided with three electron beam apertures.

The projections 17*c*" formed on the inner wall of the cup-shaped electrode according to this embodiment are configured to project radially inwardly and are drawn integrally from the electrode material. The correction plate electrode 17*a* is welded and fixed to the projections 17*c*' by laser. Other constitutions are similar to those of the previous embodiments.

Also in this embodiment, it is possible to provide precision main lens electrodes for an electron gun for a high performance cathode ray tube.

The present invention can be applied not only to the main lens electrodes but also to various electron gun electrodes having other similar internal electrodes.

According to the present invention, it becomes easy to assemble the correction plate electrode in the electrode of the type in which the correction plate electrode is inserted into and fixed to the cup-shaped electrode, it is possible to position the correction plate electrode with high accuracy, and thus a high quality cathode ray tube is provided.

What is claimed is:

1. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion; and an electron gun housed within said neck portion;

said electron gun comprising three cathodes for emitting three in-line electron beams and a plurality of electrodes each having electron beam apertures for passing said three in-line electron beams;

said plurality of electrodes being fixed in a predetermined axially spaced relationship on insulating supports, at least one of said plurality of electrodes being cup-shaped and having a correction plate electrode therein, and edges of said correction plate electrode being formed with recesses and sloped portions extending in a direction away from said recesses toward an inner wall of said at least one of said plurality of electrodes.

2. A color cathode ray tube according to claim 1, wherein said correction plate electrode is formed with a center electron beam aperture having a diameter larger in a direction perpendicular to a direction of arrangement of said three in-line electron beams than a diameter thereof in said direction of arrangement of said three in-line electron beams.

3. A color cathode ray tube according to claim 2, wherein said correction plate electrode is formed with three electron beam apertures of a shape of a closed loop.

4. A color cathode ray tube according to claim 2, wherein said correction plate electrode is formed with two side electron beam apertures formed by cutout of edges of said correction plate electrode.

5. A color cathode ray tube according to claim 1, wherein said at least one of said plurality of electrodes has a step on an inner wall thereof to provide a first portion having an inside diameter larger on an open end side thereof than that of a second portion thereof on a side opposite said open end side, and said correction plate electrode is pressed against said step and welded to said at least one of said plurality of electrodes at edges thereof.

6. A color cathode ray tube according to claim 1, wherein said at least one of said plurality of electrodes has a step on an inner wall thereof to provide a first portion having an inside diameter larger on an open end side thereof than that of a second portion thereof on a side opposite said open end side, and said correction plate electrode is welded to said second portion at edges thereof.

7. A color cathode ray tube according to claim 1, wherein said at least one of said plurality of electrodes include a focus electrode and an anode forming a main lens therebetween, said correction plate electrode being provided in said focus electrode and being formed with three electron beam apertures having a shape of a closed loop, said correction plate electrode being provided in said anode and being formed with a center electron beam aperture having a shape of a closed loop and two side electron beam apertures formed by cutout of edges thereof.

8. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion; and an electron gun housed within said neck portion;

said electron gun comprising three cathodes for emitting three in-line electron beams and a plurality of electrodes each having electron beam apertures for passing said three in-line electron beams, said plurality of electrodes being fixed in a predetermined axially spaced relationship on insulating supports, at least one of said plurality of electrodes being cup-shaped and having a correction plate electrode therein welded to an inner wall thereof at edges of said correction plate electrode, and edges of said correction plate electrode being formed with a pair of recesses above and below a center electron beam aperture of said correction plate electrode and portions of a top edge and a bottom edge of said correction plate electrode sloping downward toward said center electron beam aperture.

9. A color cathode ray tube according to claim 8, wherein said center electron beam aperture of said correction plate electrode has a diameter which is larger in a direction perpendicular to a direction of the arrangement of said three in-line electron beams than a diameter thereof in said direction of the arrangement of said three in-line three electron beams.

10. A color cathode ray tube according to claim 8, wherein said correction plate electrode is formed with three electron beam apertures of a shape of a closed loop.

11. A color cathode ray tube according to claim 8, wherein said correction plate electrode is formed with two side electron beam apertures formed by cutout of edges of said correction plate electrode.

12. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion; and an electron gun housed within said neck portion;

said electron gun comprising a plurality of electrodes including a plurality of cathodes for emitting a plurality of in-line electron beams, a control grid having a plurality of in-line electron beam apertures centered with said plurality of cathodes, respectively, an accelerating electrode, a cup-shaped focus electrode and a cup-shaped anode fixed in a predetermined axially spaced relationship and in the order named from said plurality of cathodes towards said phosphor screen, on insulating supports, each of said cup-shaped focus electrode and said cup-shaped anode having, at a first end face thereof opposing another of said cup-shaped focus electrode and said cup-shaped anode, a single opening surrounded by a rim formed by turning in said first end face thereof toward an interior thereof, each of said cup-shaped focus electrode and said cup-shaped anode having a correction plate electrode therein at a position set back from said first end face toward said interior thereof, said correction plate electrode having electron beam apertures for passing said plurality of in-line electron beams, outer dimensions of said correction plate electrode being made smaller than corresponding inner dimensions of said cup-shaped electrode, and edges of said correction plate electrode being welded to projections formed on an inner wall extending in parallel with a direction of arrangement of said plurality of in-line electron beams, of each of said cup-shaped electrodes.

13. A color cathode ray tube according to claim 12, wherein said projections are tongues drawn inwardly and integrally from said cup-shaped electrons.

14. A color cathode ray tube according to claim 12, wherein said projections are formed by extruding inwardly and locally said cup-shaped electrodes.

* * * * *

UNITED STATES PATENT AND TRADEMARK OFFICE

CERTIFICATE OF CORRECTION

PATENT NO. : 6,081,068

DATED : June 27, 2000

INVENTOR(S) : Akihito SUDO, et al.

It is certified that error appears in the above-indentified patent and that said Letters Patent is hereby corrected as shown below:

On title page, item 45 Date of Patent:
replace "*wx.-99,-9999"
with --Jun. 27, 2000--.

Signed and Sealed this

Third Day of April, 2001

*Attest:*

Nicholas P. Godici

NICHOLAS P. GODICI

*Attesting Officer*

*Acting Director of the United States Patent and Trademark Office*